US010458219B2

(12) United States Patent
Hazel et al.

(10) Patent No.: US 10,458,219 B2
(45) Date of Patent: Oct. 29, 2019

(54) DOWNHOLE STIMULATION SYSTEM

(71) Applicant: Welltec Oilfield Solutions AG, Zug (CH)

(72) Inventors: Paul Hazel, Aberdeen (GB); Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 124 days.

(21) Appl. No.: 15/321,382

(22) PCT Filed: Jun. 22, 2015

(86) PCT No.: PCT/EP2015/063940

§ 371 (c)(1),
(2) Date: Dec. 22, 2016

(87) PCT Pub. No.: WO2015/197532

PCT Pub. Date: Dec. 30, 2015

(65) Prior Publication Data

US 2017/0145801 A1 May 25, 2017

(30) Foreign Application Priority Data

Jun. 23, 2014 (EP) ..... 14173461
Mar. 20, 2015 (EP) ..... 15160034

(51) Int. Cl.
*E21B 43/26* (2006.01)
*E21B 23/00* (2006.01)
(Continued)

(52) U.S. Cl.
CPC ..... *E21B 43/26* (2013.01); *E21B 23/00* (2013.01); *E21B 33/127* (2013.01);
(Continued)

(58) Field of Classification Search
CPC ..... E21B 43/26; E21B 47/00; E21B 34/10; E21B 23/00; E21B 34/14; E21B 33/127;
(Continued)

(56) References Cited

U.S. PATENT DOCUMENTS 4,421,167 A * 12/1983 Erbstoesser ..... E21B 43/267 166/281
4,886,117 A * 12/1989 Patel ..... E21B 33/1243 277/334

(Continued)

FOREIGN PATENT DOCUMENTS

CA 2 764 764 A1 8/2012
EP 2 728 108 5/2014

(Continued)

OTHER PUBLICATIONS

International Search Report and Written Opinion of the ISA for PCT/EP2015/063940 dated Dec. 7, 2015, 12 pages.

(Continued)

*Primary Examiner* — Cathleen R Hutchins
*Assistant Examiner* — Jonathan Malikasim
(74) *Attorney, Agent, or Firm* — Nixon & Vanderhye P.C.

(57) ABSTRACT

The present invention relates to a downhole stimulation system for stimulating production. The system has first and second inflatable packers (6) for isolating a production zone (10), the packers being inflated through aperture (15), a sliding sleeve valve (17) arranged between the two packers, the sleeve having an opening (19) to provide fluid communication between the inside of the well tubular and the production zone. In operation the inflatable device is set downstream of the inflation aperture of the lower packer, the well is pressurized to move the tool downstream to open the sliding sleeve valve, whereafter fracturing fluid with proppants having a size which is smaller than that of the sliding (Continued)

sleeve opening (19) and larger than the packer inflation aperture (15), is pumped downhole using a displacement means such as a piston element.

15 Claims, 9 Drawing Sheets

(51) Int. Cl.

| | |
|---|---|
| ***E21B 33/124*** | (2006.01) |
| ***E21B 33/127*** | (2006.01) |
| ***E21B 34/14*** | (2006.01) |
| ***E21B 43/267*** | (2006.01) |
| ***E21B 34/10*** | (2006.01) |
| ***E21B 47/00*** | (2012.01) |
| ***E21B 34/00*** | (2006.01) |

(52) U.S. Cl.
CPC ..... *E21B 33/1243* (2013.01); *E21B 34/10* (2013.01); *E21B 34/14* (2013.01); *E21B 43/267* (2013.01); *E21B 47/00* (2013.01); *E21B 2034/007* (2013.01)

(58) Field of Classification Search
CPC ..... E21B 33/1243; E21B 43/267; E21B 2034/007; E21B 43/162; E21B 23/06
See application file for complete search history.

(56) References Cited

U.S. PATENT DOCUMENTS

| | | | | |
|---|---|---|---|---|
| 5,417,285 | A * | 5/1995 | Van Buskirk | E21B 33/127 166/192 |
| 6,998,557 | B2 | 2/2006 | Whanger et al. | |
| 8,720,561 | B2 * | 5/2014 | Zhou | E21B 21/103 166/177.4 |
| 9,926,773 | B2 * | 3/2018 | Hallundbæk | E21B 33/1275 |
| 2013/0244914 | A1 * | 9/2013 | Wu | C04B 35/117 507/269 |
| 2015/0021021 | A1 * | 1/2015 | Merron | E21B 34/14 166/255.1 |

FOREIGN PATENT DOCUMENTS

| | | |
|---|---|---|
| RU | 2 473 790 C1 | 1/2013 |
| RU | 2 495 994 C1 | 10/2013 |
| RU | 2 515 651 C1 | 5/2014 |
| WO | WO 2011/146210 A1 | 11/2011 |

OTHER PUBLICATIONS

Extended Search Report for EP14173461.6 dated Jan. 23, 2015, 7 pages.
Decision on Patent Grant for Invention dated Jan. 14, 2019 in Russian Application No. 2017100019/03(000020), with English Translation (21 pages).

* cited by examiner

DOWNHOLE STIMULATION SYSTEM

This application is the U.S. national phase of International Application No. PCT/EP2015/063940 filed 22 Jun. 2015 which designated the U.S. and claims priority to EP Patent Application No. 14173461.6 filed 23 Jun. 2014 and EP Patent Application No. 15160034.3 filed 20 Mar. 2015, the entire contents of each of which are hereby incorporated by reference.

FIELD OF THE INVENTION

The present invention relates to a downhole stimulation system for stimulating production of fluid from a well. The present invention further relates to a downhole stimulation method for stimulating production of fluid from a well by means of the downhole stimulation system according to the present invention.

BACKGROUND ART

One of the last steps in completing a well and bringing it into production is to expand expandable sleeves of annular barriers to isolate a production zone, and then the formation in the production zone is fractured in order to increase reservoir contact. The fracturing operation is performed by opening the frac ports and ejecting fluid out through the ports. However, when doing so, there is a risk of the pressure in the production zone increasing more than the pressure within the annular barriers, which may cause the annular barriers to collapse if the pressure difference becomes too large.

SUMMARY OF THE INVENTION

It is an object of the present invention to wholly or partly overcome the above disadvantages and drawbacks of the prior art. More specifically, it is an object to provide an improved downhole stimulation system decreasing the risk of the annular barrier collapsing while stimulating the well.

The above objects, together with numerous other objects, advantages and features, which will become evident from the below description, are accomplished by a solution in accordance with the present invention by a downhole stimulation system for stimulating production of fluid from a well having a top, comprising:

- a well tubular structure arranged in a borehole in a formation and having an inside and an inner diameter,
- a first annular barrier and a second annular barrier for isolating a production zone, the first annular barrier being arranged closest to the top of the well, each annular barrier comprising:
  - a tubular metal part for mounting as part of the well tubular structure, the tubular metal part having an outer face,
  - an expandable sleeve surrounding the tubular metal part and having an inner face facing the tubular metal part and an outer face facing a wall of the borehole, each end of the expandable sleeve being connected with the tubular metal part,
  - an annular space between the inner face of the expandable sleeve and the tubular metal part, and
  - an aperture arranged in the tubular metal part for letting fluid into the space, the aperture having a predetermined aperture size,
- a sliding sleeve having at least one profile and being arranged between two annular barriers and having a closed position and an open position in which an opening in the well tubular structure provides fluid communication between the inside of the well tubular structure and the production zone, the profile of the sliding sleeve being positioned at a first distance from the aperture of the annular space, the opening having a predetermined opening size,
- a downhole tool for bringing the sliding sleeve from the closed position to the open position, comprising:
  - a tool body, and
  - an inflatable device adapted to be inflated in the well tubular structure to divide the well tubular structure into a first part and a second part, and
  - at least one key engaging the profile so that when the inflatable device has been inflated and the first part of the well tubular structure has been pressurised, the tool is moved downstream and the key drags in the profile, forcing the sliding sleeve from the closed position to the open position, the inflatable device being arranged downstream of the aperture of the second annular barrier so that the annular space of the second annular barrier is in fluid communication with the first part of the well tubular structure when the inflatable device is inflated, wherein the downhole stimulation system further comprises a pump adapted to provide pressurised fluid down the well tubular structure in order to fracture the formation and stimulate the well, the pressurised fluid being supplied with proppants and the proppants which are smaller than the opening and larger than the aperture, and wherein the downhole stimulation system further comprises a displacement means for displacing the proppants downwards in the well, out through the opening and into the fracture.

The proppants may be made of a material having a positive buoyancy in the fluid.

Moreover, the displacement means may be an element having an outer element diameter which is substantially equal to the inner diameter of the well tubular structure.

Said displacement means may be a fluid, such as water.

Also, the expandable sleeve may be a metal sleeve.

The downhole stimulation system as described above may further comprise a third annular barrier arranged closer to the top than the first annular barrier and a fourth annular barrier arranged further away from the top than the second annular barrier, the inflatable device being inflated between the second annular barrier and the fourth annular barrier.

Moreover, the tool may comprise several keys arranged at a distance from each other.

In addition, the profile may be a circumferential groove.

Further, the sliding sleeve may be a self-closing sleeve.

Additionally, the sliding sleeve may comprise a spring for closing the sleeve.

Also, a valve may be arranged in the aperture of at least one of the annular barriers.

Said valve may be a one-way valve.

A diameter of the tool body may be smaller than an inner diameter of the well tubular structure, defining a fluid passage between the tool and the well tubular structure.

Moreover, the tool may comprise an inflation pump for inflating the inflatable device.

Furthermore, the tool may comprise a motor for driving the inflation pump.

In addition, the expandable sleeve may have a fracturing device arranged on the outer face of the expandable sleeve for fracturing the formation when the outer face is pressed against the wall of the borehole.

Also, the sliding sleeve and/or the aperture may comprise an identification tag.

Further, the tool may comprise a detection unit for detecting the sliding sleeve and/or the aperture.

Said detection unit may comprise a tag identification means for detecting the sliding sleeve and/or the aperture.

In addition, the sliding sleeve or annular barrier may comprise an identification tag.

Moreover, the detection unit may be adapted to detect the profile of the sliding sleeve and the aperture of the annular barrier in order to detect the first distance between the profile and the aperture.

Furthermore, the tool may comprise an activation means for activating the inflation pump so that the inflatable device is inflated, and for stopping the inflation pump so that the inflatable device is deflated.

The key of the tool may be arranged at a second distance from the inflatable device of the tool, the second distance being equal to or larger than the first distance.

Also, said second distance may be adjustable.

Additionally, the tool body may comprise a telescopic body arranged between the key and the inflatable device, the telescopic body being adapted to adjust the second distance in relation to the detected first distance.

The downhole stimulation system as described above may further comprise an activation sensor adapted to cause the inflatable device to deflate when a condition in the well changes.

Moreover, the tool may further comprise a detection sensor for detecting a condition of the well and/or the sleeve.

Further, the tool may comprise a communication unit for loading information from a reservoir sensor.

Also, the tool may further comprise a self-propelling means, such as a turbine or a propeller.

The well tubular structure may comprise a plurality of sliding sleeves, each sliding sleeve having an identification tag.

Furthermore, at least one of the annular barriers may have at least one intermediate sleeve between the expandable sleeve and the tubular part.

In addition, the expandable sleeve may comprise an opening.

Moreover, the tool may be wireless and may comprise a power supply.

Additionally, the tool may be connected and powered through a wireline.

The present invention also relates to a downhole stimulation method for stimulating production of fluid from a well by means of the downhole stimulation system according to any of the preceding claims, comprising the steps of:

- detecting the sliding sleeve,
- projecting the keys of the tool,
- engaging the profile of the sliding sleeve,
- inflating the inflatable device,
- pressuring the inside of the well tubular structure,
- moving the tool away from the top of the well, sliding the sleeve from a closed position to an open position,
- letting pressurised fluid from the inside of the well tubular structure in through the aperture of the second annular barrier to equalise the pressure between the production zone and the annular space of the second annular barrier,
- letting the fluid out through the opening to fracture the formation,
- supplying proppants smaller than the opening and larger than the aperture to the pressurised fluid, and
- displacing the proppants out of the opening to the fracture while equalising the pressure between the production zone and the annular space of the second annular barrier and while preventing the proppants from entering the aperture of the annular barrier.

The downhole stimulation method as described above may further comprise the step of deflating the inflatable device when a predetermined pressure or sequence of pressures is reached.

Moreover, the downhole stimulation method as described above may comprise the following steps:

- disengaging the profile so that the sliding sleeve moves into the closed position,
- moving the tool further away from the top of the well,
- detecting a second sliding sleeve,
- projecting the keys of the tool,
- engaging the profile of the second sliding sleeve,
- inflating the inflatable device,
- pressuring the inside of the well tubular structure,
- moving the tool away from the top of the well, sliding the second sliding sleeve from a closed position to an open position, and
- letting pressurised fluid from the inside of the well tubular structure in through the aperture of the fourth annular barrier to equalise the pressure between the production zone and the annular space of the fourth annular barrier.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
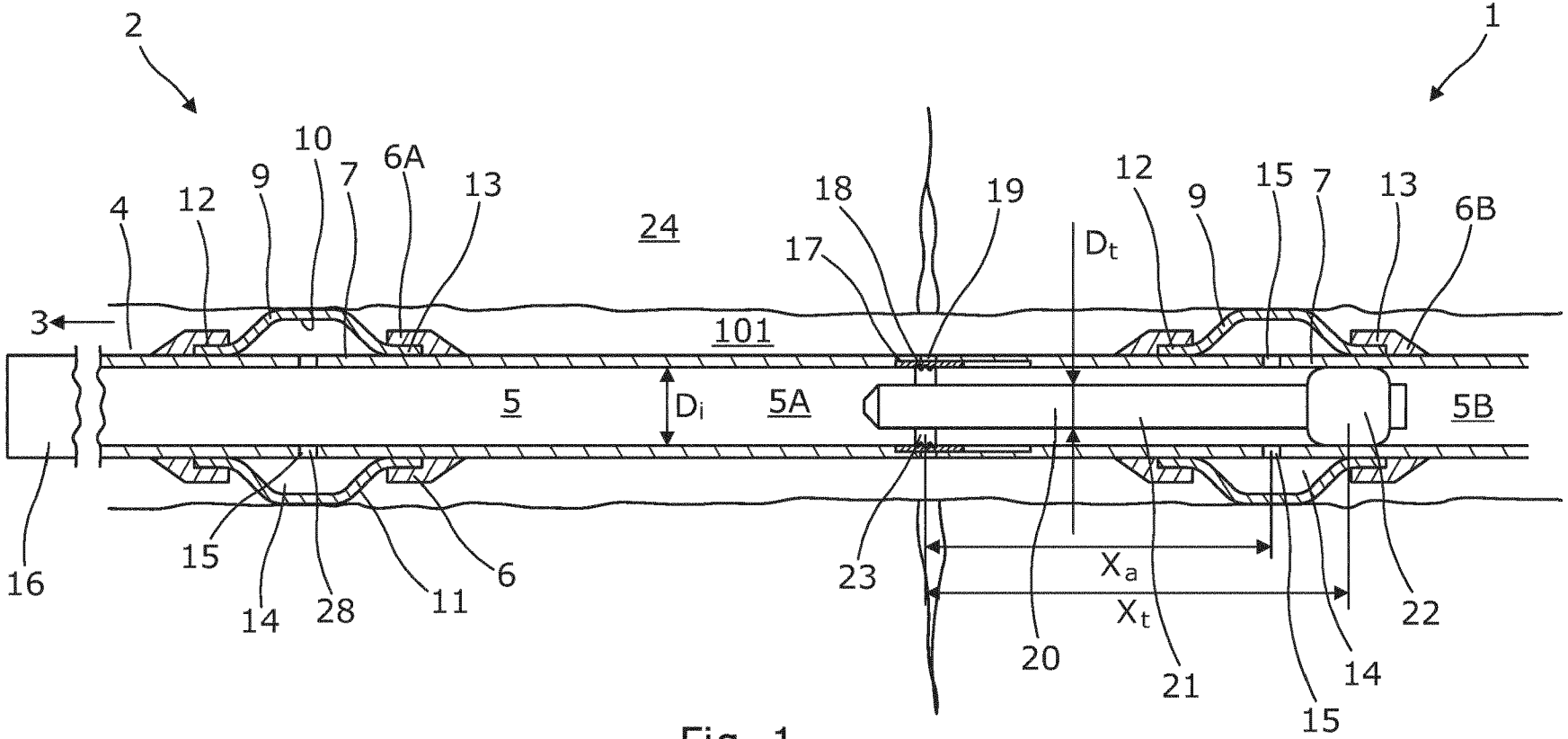
FIG. 1 shows a partly cross-sectional view of a downhole stimulation system for stimulating production of hydrocarbon-containing fluid from a well.

FIG. 1 shows a downhole stimulation system 1 for stimulating production of hydrocarbon-containing fluid from a well 2. The downhole stimulation system 1 comprises a well tubular structure 4 and a first annular barrier 6, 6A and a second annular barrier 6, 6B for isolating a production zone 101. The first annular barrier 6, 6A is arranged closest to a top of the well 2. Each annular barrier 6, 6A, 6B comprises a tubular metal part 7 mounted as part of the well tubular structure 4 and an expandable sleeve 9 surrounding the tubular metal part and having an inner face 10 facing the tubular metal part and an outer face 11 facing the wall of the borehole. Each end 12, 13 of the expandable sleeve 9 is connected with the tubular metal part 7, defining an annular space 14 between the inner face 10 of the expandable sleeve and the tubular metal part. The annular barrier further comprises an aperture 15 arranged in the tubular metal part 7 for letting fluid into the annular space 14.

The downhole stimulation system 1 comprises a pump 16 adapted to provide pressurised fluid down the well tubular structure 4 in order to stimulate the well 2, and the pump may also be used for expanding the expandable sleeves 9 of the annular barriers 6, 6A, 6B by letting pressurised fluid in through the aperture 15. The downhole stimulation system 1 further comprises a sliding sleeve 17 having at least one profile 18, and the sliding sleeve 17 is arranged between two annular barriers 6, 6A, 6B and has a closed position and an open position. In the open position, the sliding sleeve 17 allows fluid communication between the inside of the well tubular structure 4 and the production zone 101 through an opening 19 in the well tubular structure 4. The profile 18 of the sliding sleeve 17 is positioned at a first distance $X_a$ from the aperture 15 of the annular space 14.

In addition, the downhole stimulation system 1 comprises a downhole tool 20 for bringing the sliding sleeve 17 from the closed position to the open position. The downhole tool 20 comprises a tool body 21 and an inflatable device 22 adapted to be inflated inside the well tubular structure 4 to divide the inside 5 of the well tubular structure 4 into a first part 5A and a second part 5B. The downhole tool 20 further comprises at least one key 23 engaging the profile 18 in the sliding sleeve 17, so that when the inflatable device 22 has been inflated and the first part of the well tubular structure 4 has been pressurised, the downhole tool is moved downstream and the keys 23 of the downhole tool drag in the profile, forcing the sliding sleeve 17 from the closed position to the open position. The inflatable device 22 is arranged downstream of the aperture 15 of the second annular barrier 6, 6B so that the annular space 14 of the second annular barrier is in fluid communication with the first part 5A of the well tubular structure 4 when the inflatable device 22 is inflated. In this way, the pressurised fluid jetted out through the opening 19 in the well tubular structure 4 is also able to flow from the inside 5 of the well tubular structure in through the aperture 15 of the second annular barrier 6, 6B and into the annular space 14 to equalise the pressure between the production zone 101 and the annular space of the second annular barrier 6, 6B. When fracturing the formation in order to gain more reservoir contact, pressurised fluid is jetted out through such an opening 19 in the well tubular structure 4. However, such an increase in the pressure in the production zone 101 may compromise the isolation properties of the second annular barrier 6, 6B if the inflatable device 22 is not located downstream of the aperture 15 and thus further away from the top of the well 2 than the aperture.

In order to stimulate a well 2, the sliding sleeve 17, through which the fracturing is to occur, is detected, and then the keys 23 of the tool 20 are projected to engage the profile 18 of the sliding sleeve 17. Shortly thereafter or simultaneously, the inflatable device 22 is inflated, and then the inside 5 of the well tubular structure 4 is pressurised, whereby the pressurised fluid in the well tubular structure applies pressure onto the inflatable device 22, moving the downhole tool 20 away from the top of the well 2, sliding the sleeve 17 from a closed position to an open position and letting pressurised fluid from the inside 5 of the well tubular structure 4 in through the aperture 15 of the second annular barrier 6, 6B to equalise the pressure between the production zone 101 and the annular space 14 of the second annular barrier. Subsequently, the inflatable device 22 is deflated when a predetermined pressure or sequence of pressures is/are reached.

The profile 18 of the sliding sleeve 17 has circumferential grooves matching the profile of the keys 23, so that the keys are able to get a firm grip on the sliding sleeve. As can be seen in FIG. 1, the tool 20 has a diameter $D_t$ of the tool body 21 which is smaller than an inner diameter $D_i$ of the well tubular structure 4, defining a fluid passage between the downhole tool 20 and the well tubular structure. The expandable sleeve 9 is a metal sleeve and may be expanded by letting pressurised fluid in through the aperture 15 of the annular barrier 6.

Figure 2:
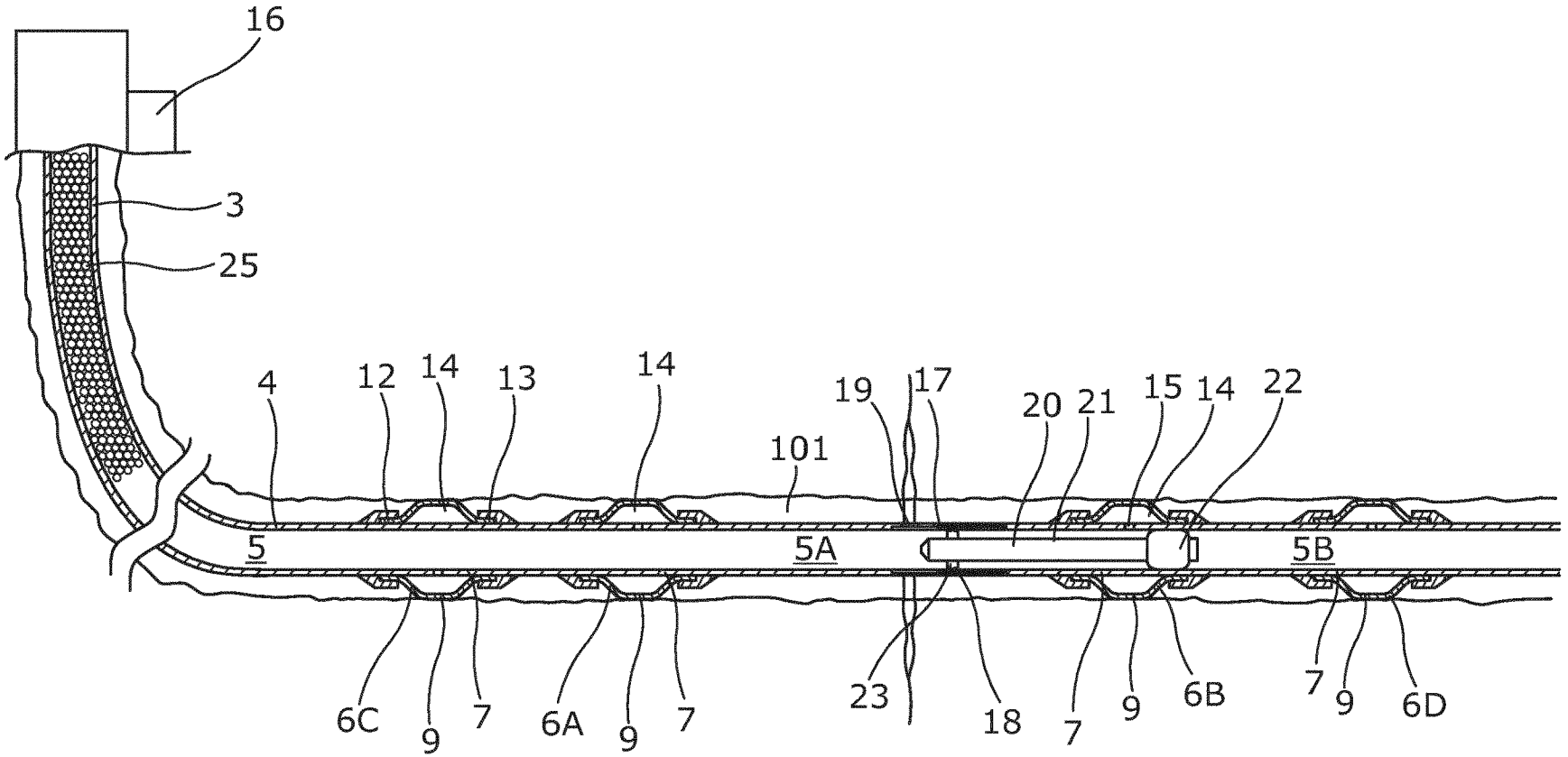
FIG. 2 shows a partly cross-sectional view of another downhole stimulation system.

When the sliding sleeve 17 has been moved to uncover the opening 19 in the well tubular structure 4, pressurised fluid comprising proppants 25 is pumped down the well tubular structure in order to fracture the formation and stimulate the well, as shown in FIG. 2. The pressurised fluid is supplied with proppants 25 which are smaller than the opening 19 but larger than the aperture 15, preventing the proppants 25 from entering the annular space 14 in the annular barrier 6.

Furthermore, the proppants 25 are made of a material having a positive buoyancy in the fluid, and the proppants 25 therefore stay at the top of the well so that only the pressurised fluid is ejected through the opening 19 when the formation is fractured, as shown in FIG. 2. Subsequently, a displacement means is arranged in the well for displacing the proppants 25 downwards in the well and, through the opening 19 and into the fracture, as shown in FIG. 2. Due to the aperture 15 being smaller than the proppants 25, the proppants cannot flow into the annular barrier 6 but merely out through the intended opening 19 in the well tubular structure 4 and into the fractures to maintain the fractures open during a subsequent production. By having a positive buoyancy, the proppants 25 do not accumulate in the area of the downhole tool 20, which would disturb the function of the tool, preventing the tool from being able to seal or even retract when the fracturing process has ended.

Figure 7:
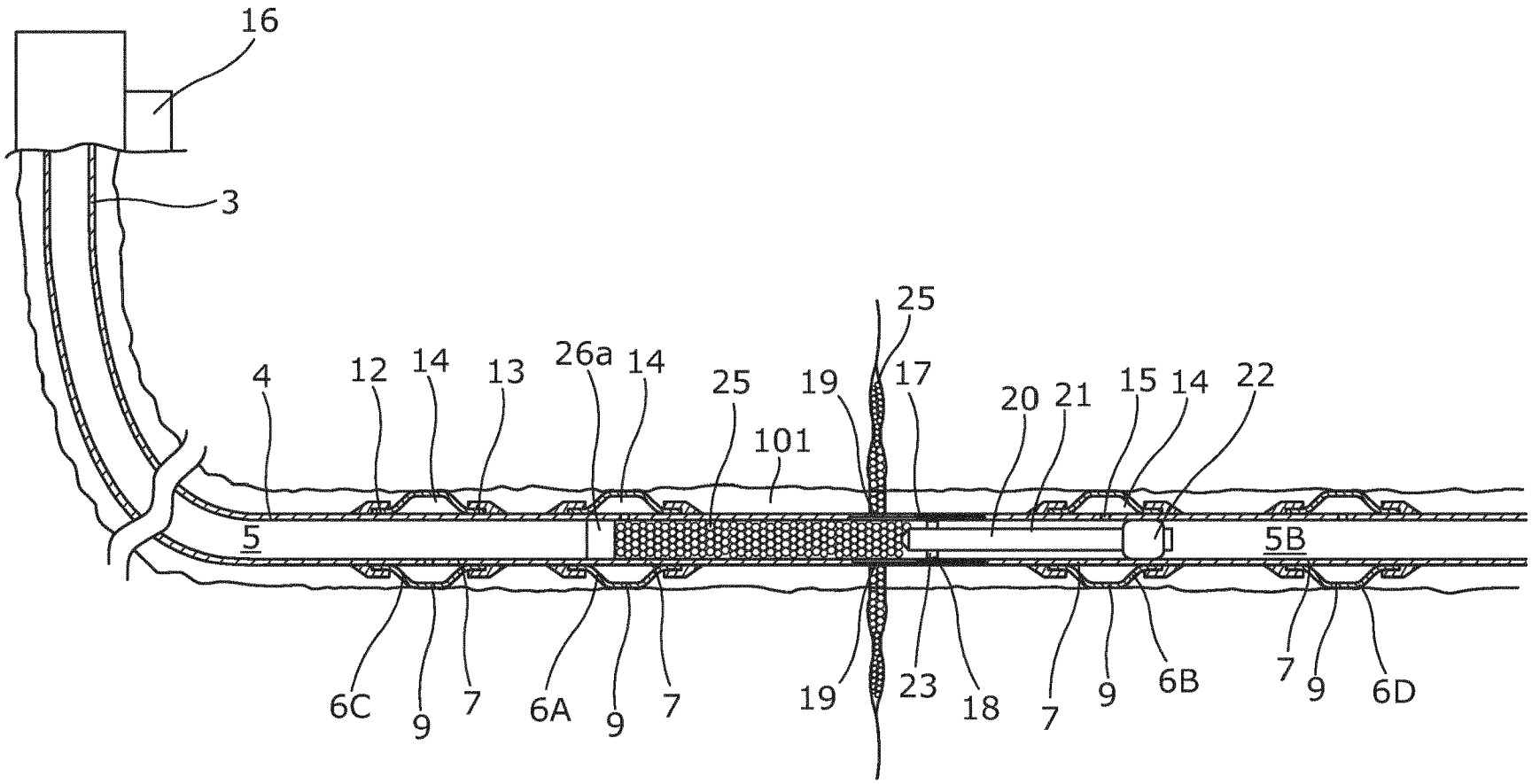
FIG. 7 shows a partly cross-sectional view of the downhole stimulation system of FIG. 2, having the proppants displaced by means of a piston element.

As shown in FIG. 7, the displacement means is an element 26*a*, such as a piston element, having an outer element diameter which is substantially equal to the inner diameter of the well tubular structure 4. The element 26*a* is pressed downwards towards the sliding sleeve 17 by pressurised fluid delivered from surface or the well head or the blow-out preventer at the top of the well, the fluid pressing onto the element to move the element acting as a piston.

Figure 8:
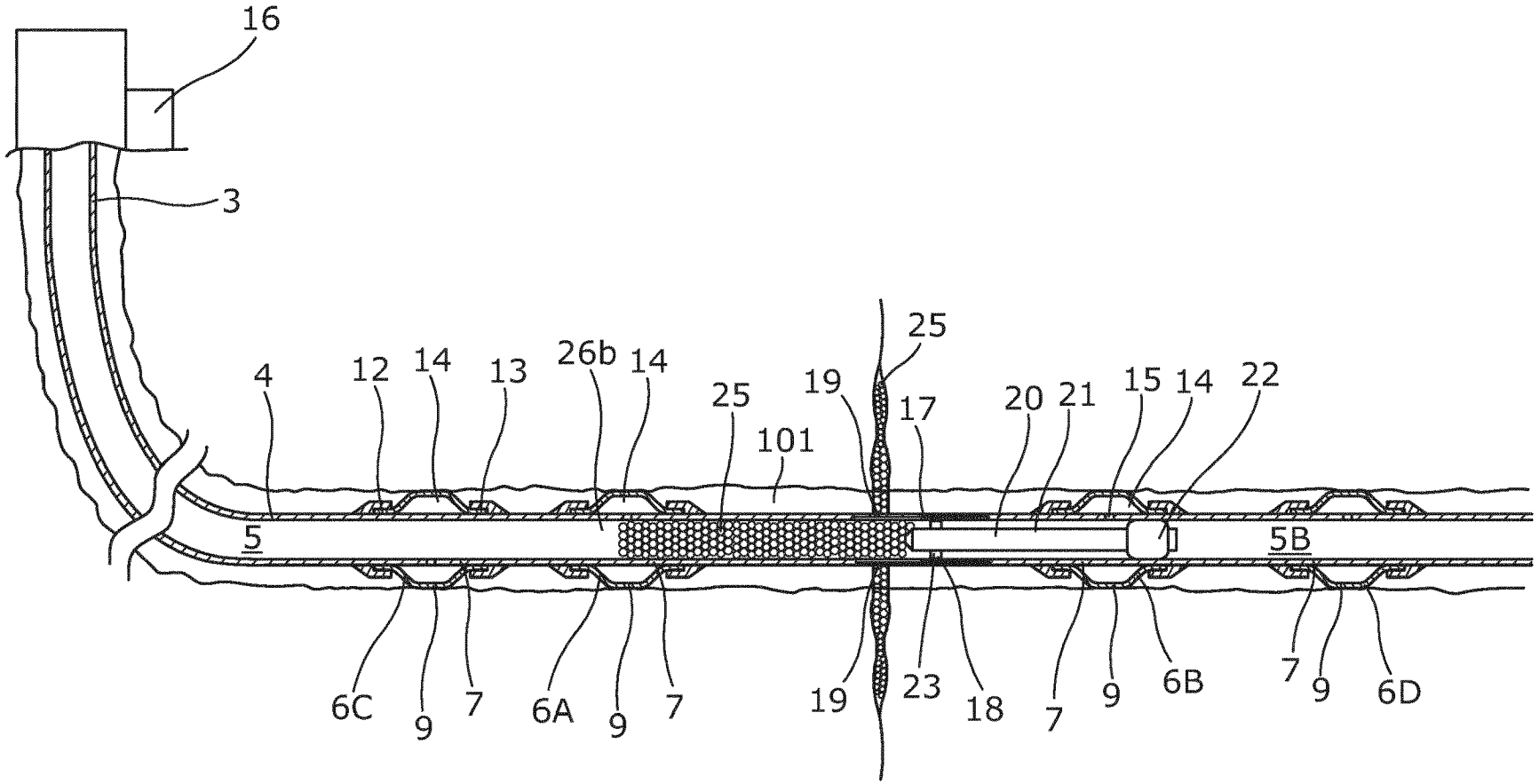
FIG. 8 shows a partly cross-sectional view of the downhole stimulation system of FIG. 2, having the proppants displaced by means of fluid.

In FIG. 8, the displacement means is a fluid 26*b* having another density than the fracturing fluid and forming a fluid front pressing onto the proppants 25, thereby forcing the proppants towards the opening and out into the fractures just created.

Figure 9:
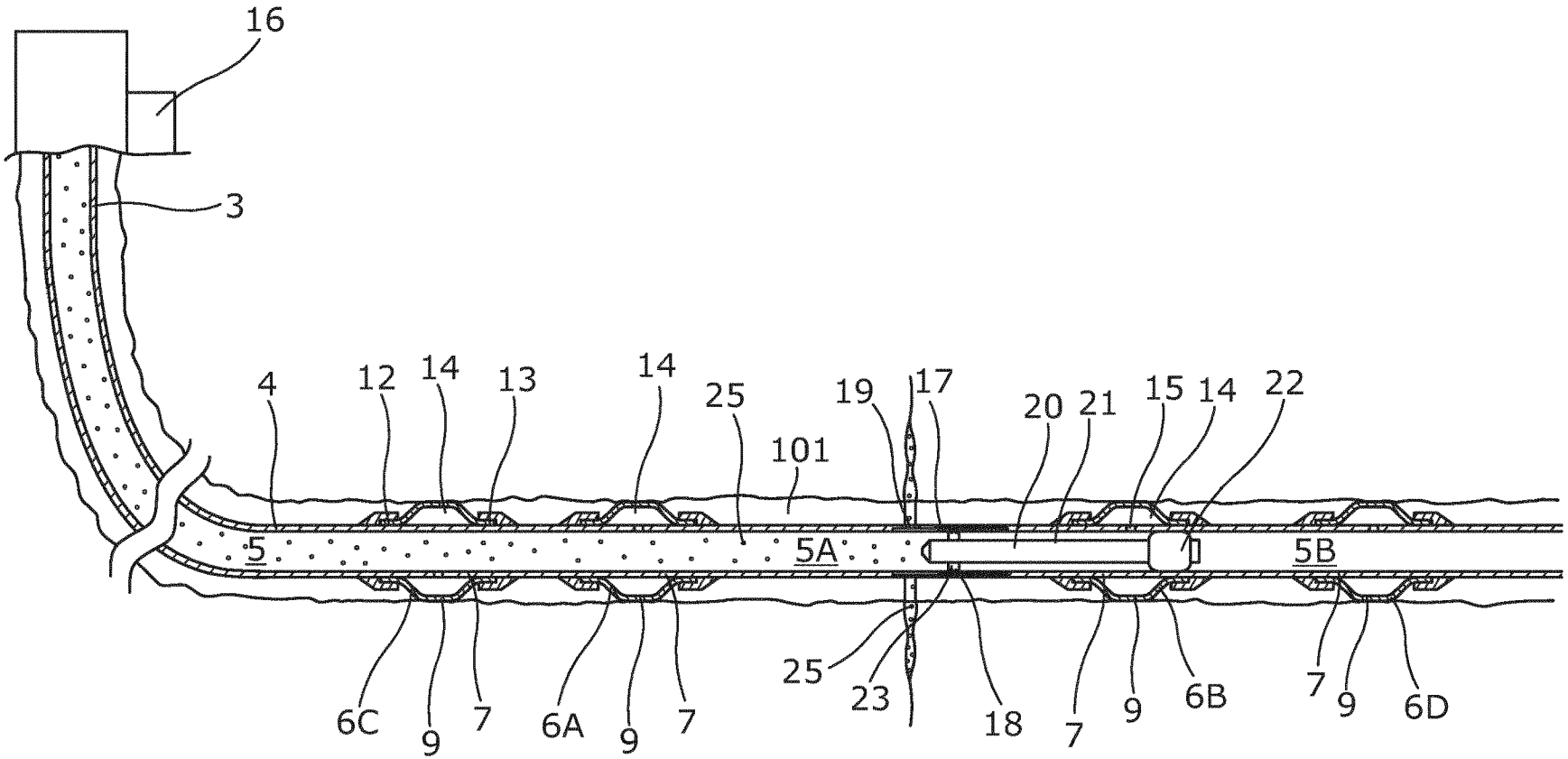
FIG. 9 shows a partly cross-sectional view of the downhole stimulation system of FIG. 2, comprising proppants having a substantially neutral buoyancy.

In FIG. 9, the proppants 25 have a substantially neutral or slightly positive buoyancy, allowing the proppants to easily flow along with the fracturing fluid and into the fractures without accumulating inside the well tubular structure 4 on top of the downhole tool 20, which would reduce the effect of the fracturing fluid, if not block the passage of fracturing fluid through the opening 19. Furthermore, the proppants 25 will not accumulate around the downhole tool 20 and prevent the function thereof.

A valve 28 may be arranged in the aperture 15 of the annular barrier 6, as shown in FIG. 1, and the valve may be a one-way valve so that fluid is allowed into the annular space 14 but unable to flow out of the space. When having a valve 28 in the aperture 15, the expandable sleeve 9 may be expanded by means of a compound which is arranged in the annular space 14 and is decomposable when subjected to heat-generating gas, which expands the sleeve 9.

In FIG. 2, the downhole stimulation system 1 further comprises a third annular barrier 6, 6C arranged closer to the top than the first annular barrier 6, 6A and a fourth annular barrier 6D arranged further away from the top than the second annular barrier, and the inflatable device 22 is inflated between the second annular barrier 6, 6B and the fourth annular barrier 6, 6D. By having two annular barriers arranged on either side of the production zone, a double barrier is provided so that if one barrier fails, the other will still provide the seal.

Figure 3:
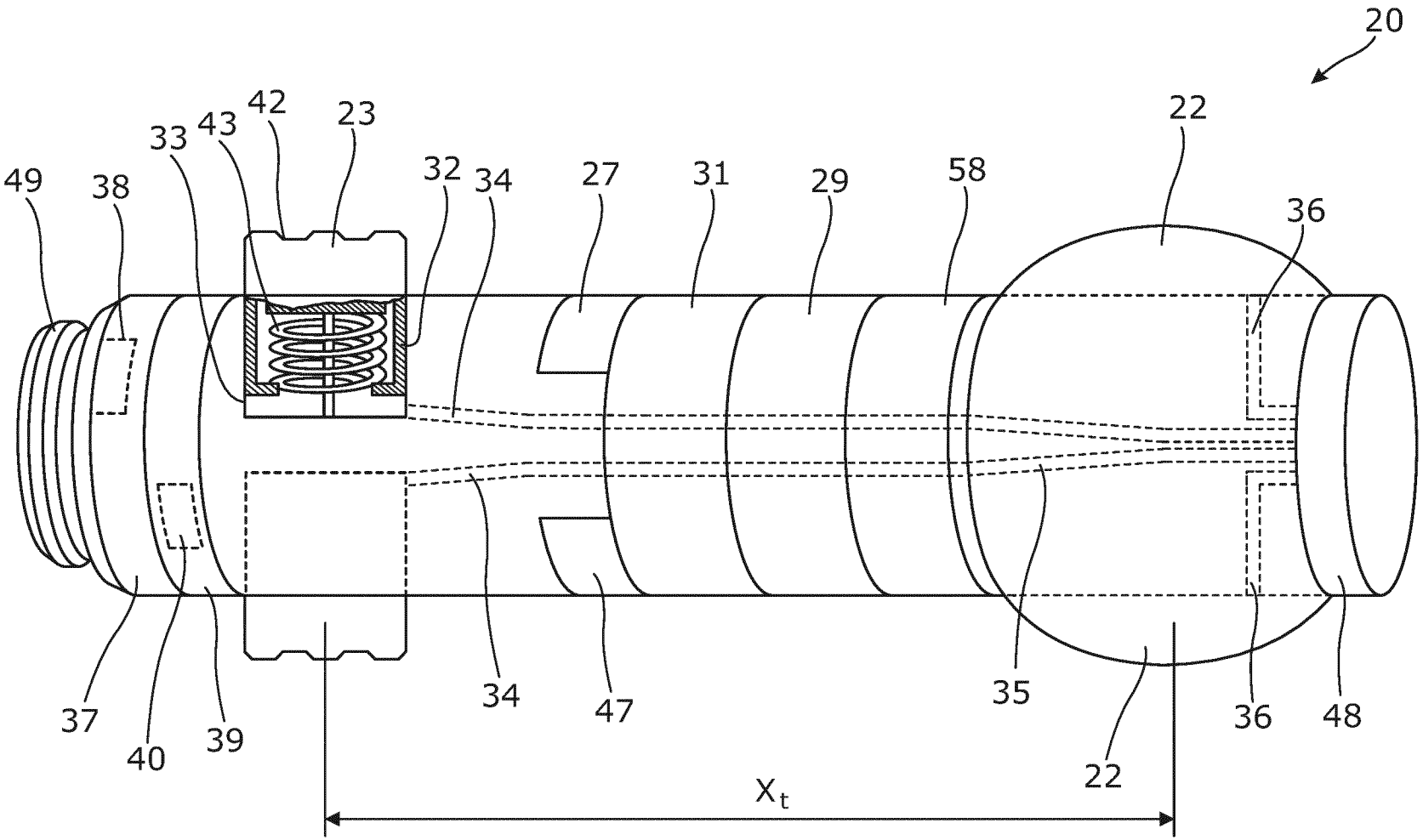
FIG. 3 shows a tool for operating a sliding sleeve.

In FIG. 3, the downhole tool 20 comprises an inflation pump 29 for inflating the inflatable device 22. The tool 20 further comprises a motor 31 for driving the inflation pump 29. The downhole tool of FIG. 3 is wireless and is powered by a power supply 58, such as a rechargeable battery. The keys 23 of the tool 20 are arranged at a second distance $X_t$ from the inflatable device 22 of the tool 20, and as shown in FIG. 3, the second distance $X_t$ is larger than the first distance. The second distance $X_t$ may also be equal to the first distance in another embodiment. The keys are projectable keys 23 forming a piston part 32 which is slidable in a cavity 33 and projected by hydraulic fluid from the pump 29 through channels 34, compressing a spring 43, which ensures that the keys return to their retracted position when they are no longer required or if the power is cut off. The keys 23 have a profile 42 matching the profile in the sliding sleeve. The pump further inflates the inflatable device 22 through channels 35. When deflated, the fluid leaves the inflatable device 22 through other channels 36.

The downhole tool 20 further comprises a detection unit 37 for detecting the sliding sleeve. The detection unit 37 comprises a tag identification means 38 for detecting the sliding sleeve. The tool 20 further comprises an activation means 39 for activating the inflatable device 22 to both inflate and deflate when e.g. the fracturing operation has ended. The activation means 39 comprises an activation sensor 40 adapted to cause the inflatable device 22 to deflate when a condition in the well changes, such as when a predetermined pressure is reached.

The downhole tool 20 further comprises a detection sensor 27 for detecting a condition of the well and/or the sliding sleeve, so that the operation is terminated if the conditions vary too much from the expected conditions. The tool also comprises a communication unit 47 for loading information from a reservoir sensor if requested.

In order to be able to propel itself up again, the downhole tool 20 comprises a self-propelling means 48, such as a turbine or a propeller. So when descending, a battery in the tool is charged to be ready for use when the tool emerges at the top of the well again. The tool further comprises a fishing neck 49, making the tool easily retrievable from the well.

Figure 4:
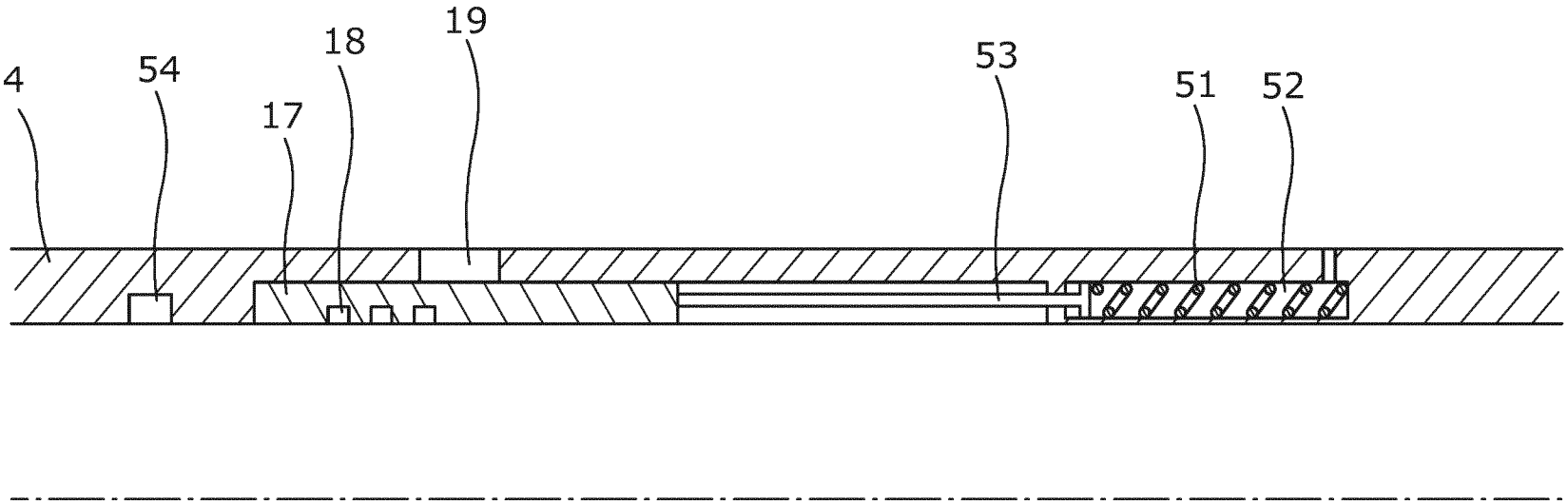
FIG. 4 shows a cross-sectional view of another sliding sleeve.

In FIG. 4, the sliding sleeve 17 is a self-closing sleeve comprising a spring 51 for closing the sleeve. When the downhole tool moves the sliding sleeve 17 from a closed position to an open position, the spring in a cylinder housing 52 is compressed through the piston 53. The sliding sleeve 17 further comprises an identification tag 54 so that one sliding sleeve is recognisable from another. Thus, the well tubular structure 4 may comprise a plurality of sliding sleeves 17, each sliding sleeve having an identification tag 54.

Figure 5:
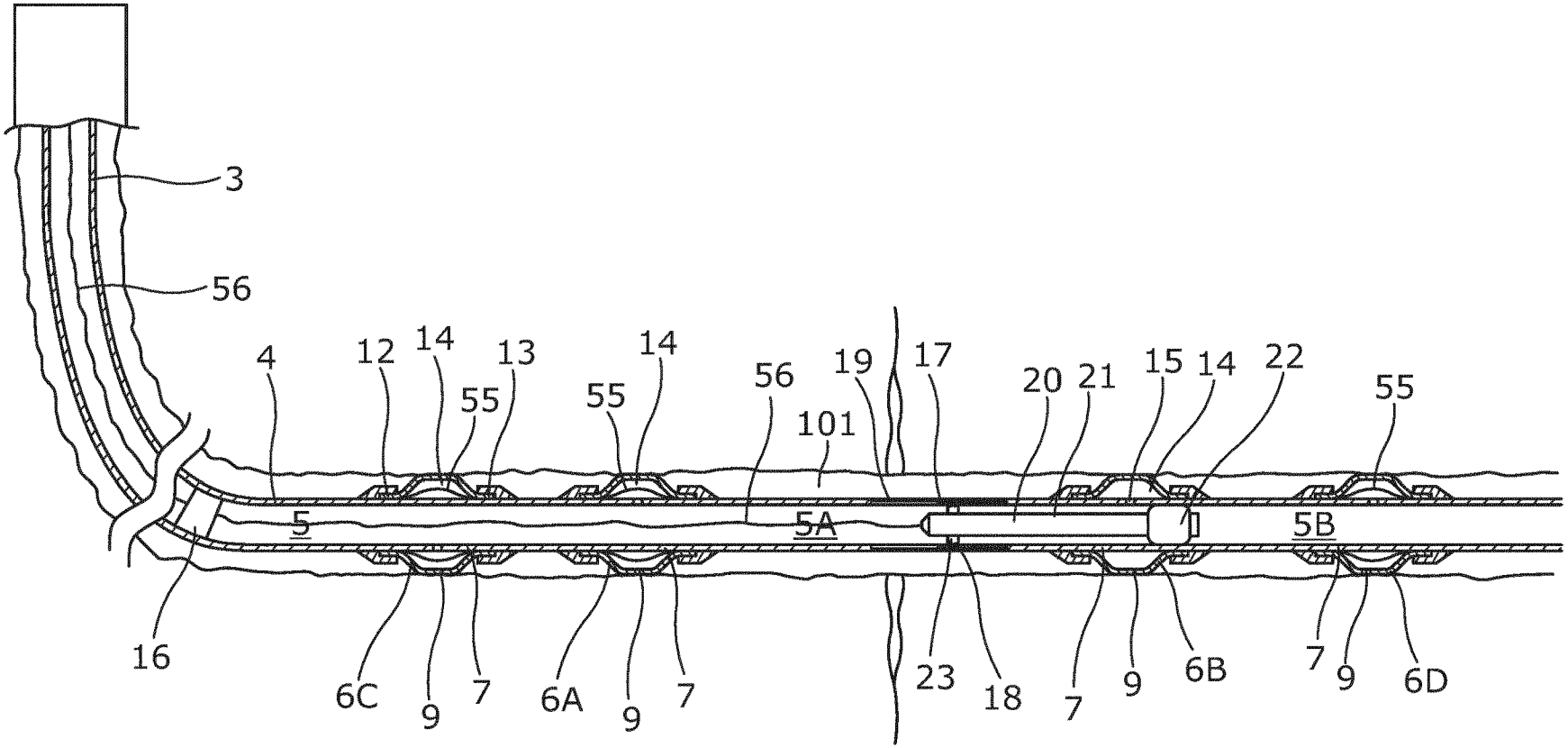
FIG. 5 shows a partly cross-sectional view of another downhole stimulation system.

Some of the annular barriers 6 may have at least one intermediate sleeve 55 between the expandable sleeve 9 and the tubular metal part 7, as shown in FIG. 5. When having the intermediate sleeve 55, the expandable sleeve 9 comprises an opening for equalising the pressure between the reservoir and the inside of the annular barrier 6, in that the intermediate sleeve seals between the reservoir and the inside 5 of the well tubular structure 4.

In FIG. 5, the pump pressurising the fluid for e.g. fracturing is submerged into the well tubular structure 4 and powered through a wireline 56 so that only part of the well tubular structure is pressurised. The downhole tool 20 may be wireless, as shown in FIGS. 1-3, or be powered through a wireline 56, as shown in FIG. 5.

Figure 6:
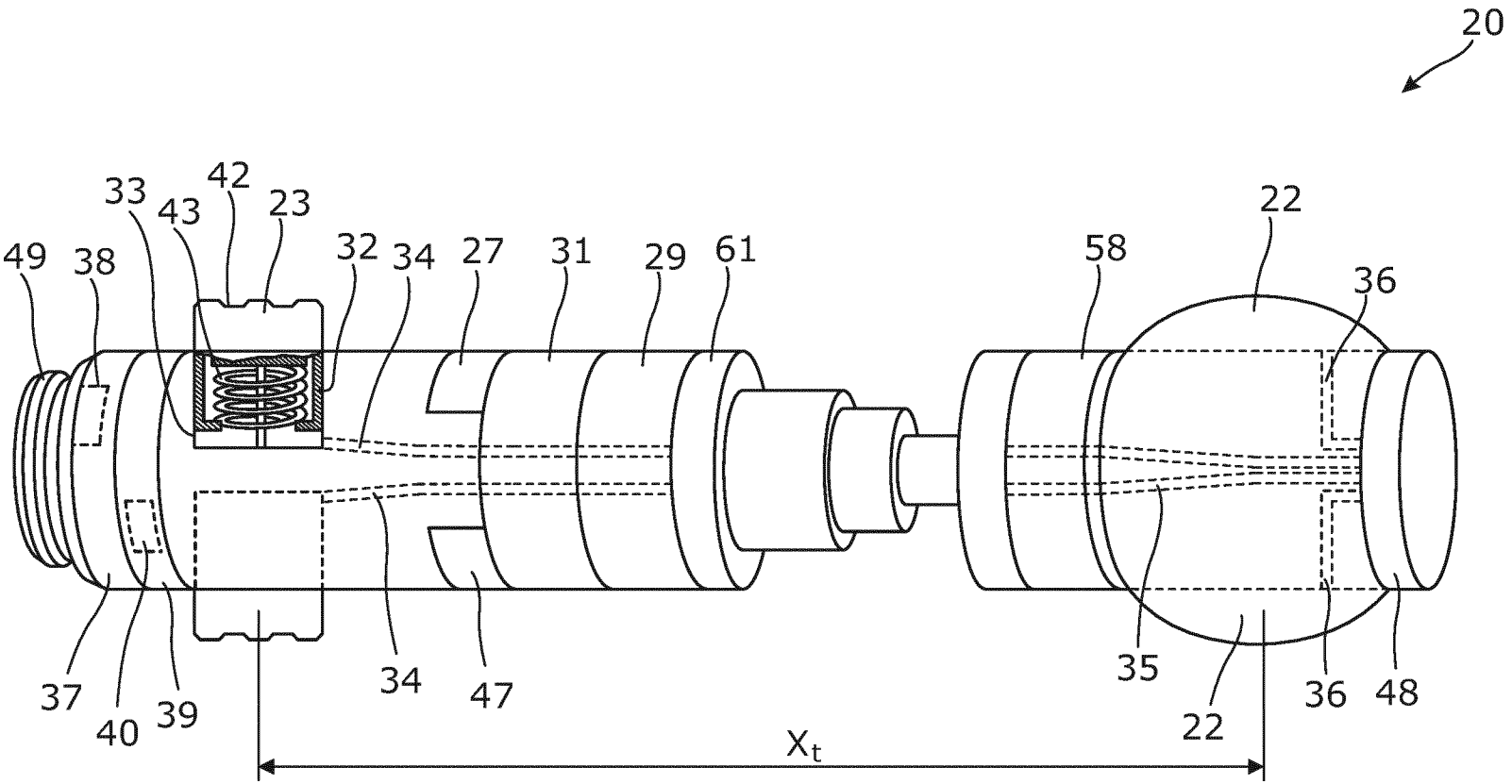
FIG. 6 shows another tool for operating a sliding sleeve.

In FIG. 6, the downhole tool 20 comprises a detection unit 37 for detecting the sliding sleeve and the aperture in order to determine the first distance $X_a$ (shown in FIG. 1). Thus, the detection unit 37 comprises a tag identification means 38 for detecting the profile of the sliding sleeve and the aperture of the annular barrier, and thus for detecting the first distance $X_a$ between the profile and the aperture. The keys 23 of the tool 20 are arranged at a second distance $x_t$ from the inflatable device 22 of the downhole tool, and the second distance is adjustable because the tool body comprises a length adjustable section 61 arranged between the key 23 and the inflatable device 22. The adjustable section 61 is adapted to adjust the second distance in relation to the detected first distance, and in FIG. 6, the length adjustable section is a telescopic section. If the first distance between the profile of the sliding sleeve and the aperture is known before entering the well, the length of the tool does not need to be adjustable and the length adjustable section 61 can be dispensed with. However, if the first distance between the profile of the sliding sleeve 17 and the aperture is not known before entering the well, or if the first distance seems to be different from what appears in the completion diagram, the tool length, and thus the second distance, is adjusted so as to fit the respective sliding sleeve.

When the stimulation operation through one sliding sleeve has ended, the downhole tool disengages the profile, causing the sliding sleeve to move into the closed position, and the tool moves further away from the top of the well. Then a second sliding sleeve is detected, the keys 23 of the tool are projected to engage the profile of the second sliding sleeve, and the inflatable device is inflated. Then, the inside of the well tubular structure is pressurised, moving the tool away from the top of the well and sliding the second sliding sleeve from a closed position to an open position and letting pressurised fluid from the inside of the well tubular structure in through the aperture of the adjacent annular barrier, e.g. a fourth annular barrier, equalising the pressure between the production zone and the annular space of the fourth annular barrier.

The proppants may comprise glass bubbles, cenospheres, microspheres and/or other similar materials having a structure which is adequate for functioning as a proppant while remaining generally buoyant in a fracturing fluid. The proppant may comprise a composite material, such as a syntactic foam, a porous material, such as an aerogel, a resin-coated aerogel, a resin-coated pumice, a ceramic foam or other type of foamed material, a crystalline material, such as zircon or other similar crystalline materials, or combinations thereof. As used herein, a "porous material" can include particles having cylindrical and/or tubular structures (e.g. having an axial bore) through which fluid can pass. The porous material may be permeable to reservoir fluids, such as a filter material that permits passage of the fluid into and through the proppants, while the structure of the material enables the proppant to keep the fracture from decreasing. The proppants may further comprise, such as in the form of an outermost layer, a friction-reducing additive to facilitate transport of the proppants.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular structure, a casing or a production casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole stimulation system for stimulating production of fluid from a well having a top, comprising:

a well tubular structure arranged in a borehole in a formation and having an inside and an inner diameter, a first annular barrier and a second annular barrier for isolating a production zone, the first annular barrier being arranged closest to the top of the well, each annular barrier comprising:

a tubular metal part for mounting as part of the well tubular structure, the tubular metal part having an outer face, an expandable sleeve surrounding the tubular metal part and having an inner face facing the tubular metal part and an outer face facing a wall of the borehole, each end of the expandable sleeve being connected with the tubular metal part, an annular space between the inner face of the expandable sleeve and the tubular metal part, and an aperture arranged in the tubular metal part for letting fluid into the space, the aperture having a predetermined aperture size, a sliding sleeve having at least one profile and being arranged between two annular barriers and having a closed position and an open position in which an opening in the well tubular structure provides fluid communication between the inside of the well tubular structure and the production zone, the profile of the sliding sleeve being positioned at a first distance from the aperture of the annular space, the opening having a predetermined opening size, a downhole tool for bringing the sliding sleeve from the closed position to the open position, comprising:

a tool body, and an inflatable device adapted to be inflated in the well tubular structure to divide the well tubular structure into a first part and a second part, and at least one key engaging the profile so that when the inflatable device has been inflated and the first part of the well tubular structure has been pressurised, the tool is moved downstream and the key drags in the profile, forcing the sliding sleeve from the closed position to the open position, the inflatable device being arranged downstream of the aperture of the second annular barrier so that the annular space of the second annular barrier is in fluid communication with the first part of the well tubular structure when the inflatable device is inflated to equalize the pressure between the production zone and the annular space of the second annular barrier, wherein the downhole stimulation system further comprises a pump adapted to provide pressurised fluid down the well tubular structure and into the opening in order to fracture the formation and stimulate the well, the pressurised fluid being supplied with proppants and the proppants having a size which is smaller than that of the opening and larger than each one of the apertures to allow the proppants to enter the opening and to prevent the proppants from entering the aperture of each said annular barrier, and wherein the downhole stimulation system further comprises a displacement means for displacing the proppants downwards in the well, out through the opening and into the fracture.

2. The downhole stimulation system according to claim 1, wherein the proppants are made of a material having a positive buoyancy in the fluid.

3. The downhole stimulation system according to claim 1, wherein the displacement means is an element having an outer element diameter which is substantially equal to the inner diameter of the well tubular structure.

4. The downhole stimulation system according to claim 1, further comprising a third annular barrier arranged closer to the top than the first annular barrier and a fourth annular barrier arranged further away from the top than the second annular barrier, the inflatable device being inflated between the second annular barrier and the fourth annular barrier.

5. The downhole stimulation system according to claim 1, wherein the sliding sleeve is a self-closing sleeve.

6. The downhole stimulation system according to claim 5, wherein the sliding sleeve comprises a spring for closing the sleeve.

7. The downhole stimulation system according to claim 1, wherein a valve is arranged in the aperture of at least one of the annular barriers.

8. The downhole stimulation system according to claim 1, wherein a diameter of the tool body is smaller than an inner diameter of the well tubular structure, defining a fluid passage between the tool and the well tubular structure.

9. The downhole stimulation system according to claim 1, wherein the tool comprises an inflation pump for inflating the inflatable device.

10. The downhole stimulation system according to claim 9, wherein the tool comprises a motor for driving the inflation pump.

11. The downhole stimulation system according to claim 1, wherein the sliding sleeve and/or the aperture comprises an identification tag.

12. The downhole stimulation system according to claim 1, wherein the tool comprises a detection unit for detecting the sliding sleeve and/or the aperture.

13. The downhole stimulation system according to claim 12, wherein the detection unit comprises a tag identification means for detecting the sliding sleeve and/or the aperture.

14. The downhole stimulation system according to claim 1, wherein at least one of the annular barriers has at least one intermediate sleeve between the expandable sleeve and the tubular part.

15. A downhole stimulation method for stimulating production of fluid from a well by means of the downhole stimulation system according to claim 1, comprising:

detecting the sliding sleeve, projecting the keys of the tool, engaging the profile of the sliding sleeve, inflating the inflatable device, pressuring the inside of the well tubular structure, moving the tool away from the top of the well, sliding the sleeve from a closed position to an open position, letting pressurised fluid from the inside of the well tubular structure in through the aperture of the second annular barrier to equalise the pressure between the production zone and the annular space of the second annular barrier, letting the fluid out through the opening to fracture the formation, supplying proppants having a size which is smaller than that of the opening and larger than the aperture to the pressurised fluid, and displacing the proppants out of the opening to the fracture while equalising the pressure between the production zone and the annular space of the second annular barrier and while preventing the proppants from entering the aperture of each said annular barrier.

* * * * *